US008113852B2

(12) United States Patent
Tamura

(10) Patent No.: US 8,113,852 B2
(45) Date of Patent: Feb. 14, 2012

(54) CONNECTOR AND INTERPOSER USING CONNECTOR

(75) Inventor: Akira Tamura, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 12/821,796

(22) Filed: Jun. 23, 2010

(65) Prior Publication Data

US 2011/0003488 A1 Jan. 6, 2011

(30) Foreign Application Priority Data

Jul. 2, 2009 (JP) ..... 2009-158159

(51) Int. Cl.
*H01R 12/00* (2006.01)

(52) U.S. Cl. ..... 439/66; 439/74

(58) Field of Classification Search ..... 439/66, 439/74

See application file for complete search history.

(56) References Cited

U.S. PATENT DOCUMENTS 3,954,317 A * 5/1976 Gilissen et al. ..... 439/591
6,106,305 A * 8/2000 Kozel et al. ..... 439/66
6,264,476 B1 7/2001 Li et al.
7,585,174 B2 * 9/2009 Ju ..... 439/66
7,614,884 B2 * 11/2009 Kuwahara et al. ..... 439/66
7,654,827 B2 * 2/2010 Arai et al. ..... 439/66

FOREIGN PATENT DOCUMENTS

JP 2001-176580 6/2001
JP 2006-066407 3/2006

* cited by examiner

*Primary Examiner* — Hien Vu
(74) *Attorney, Agent, or Firm* — Squire Sanders (US) LLP

(57) ABSTRACT

A connector conducting electricity between external electrodes while the connector is being compressed, the connector including: a columnar main body made of an elastic dielectric; a first contact terminal made of an inelastic conductor including first and second electrode sections provided on a top surface and a side surface of the columnar main body and a coupling section interconnecting the first and second electrode sections; a second contact terminal made of an inelastic conductor including third and fourth electrode sections provided on a bottom surface and a side surface of the columnar main body and a coupling section interconnecting the third and fourth electrode sections, the fourth electrode section being disposed in a position in which the fourth electrode section does not contact the second electrode section; and a conductor provided outside the main body and conducting electricity between the second and fourth electrode sections.

5 Claims, 7 Drawing Sheets

CONNECTOR AND INTERPOSER USING CONNECTOR

CROSS REFERENCE TO RELATED APPLICATION

This application is based upon and claims the benefit of priority from the prior Japanese Patent Application NO. 2009-158159 filed on Jul. 2, 2009, the entire contents of which are incorporated herein by reference.

FIELD

The embodiments discussed herein are related to a connector electrically interconnects two opposed electrodes and an interposer using the connector.

BACKGROUND

When a semiconductor integrated circuit (IC) is mounted onto a circuit board, conventionally leads provided on the sides of the IC package are inserted into through-holes provided in lands of a circuit pattern on the circuit board and soldered to electrically connect to the lands. The numbers of input and output terminals of ICs have increased with the increase of the integration densities of ICs in these years. In addition, the operating frequencies of ICs have also increased. Along with the demand for high frequency characteristics has come growing demand for high-density mounting on circuit boards, short-distance interconnections, and finer pitches.

In these circumstances, a technique has been proposed in which input and output terminals are arranged in a grid array on the bottom surface of an IC package and an interposer is used to mount the IC package onto a circuit board in order to efficiently arrange the input and output terminals. An interposer is a thin high-terminal-density connector in which holes corresponding to input and output terminals arranged in a grid array of an IC package are provided in a sheet of insulating material and conductors (connectors) that conduct electricity between both surfaces of the sheet of insulating material are inserted in the holes.

Terminals are also provided on the circuit board in the similar grid array pattern.

Japanese Laid-open Patent Publication No. 2006-66407 discloses elastic connectors employing silicon spring electrodes. Japanese Laid-open Patent Publication No. 2001-176580 discloses an elastic connector in which wires formed in zig-zags, pleats or coils are incorporated in buttons made of an elastic material. JP-A-2001-176580 also discloses metal springs may be used instead of the wires.

However, the structure that uses silicon spring electrodes to make connecters elastic has a problem that the silicon spring electrodes have high electrical resistance. The configurations in which zig-zag, pleat or coiled wires or metal springs are incorporated in elastic main bodies have a problem that they are physically difficult to miniaturize.

SUMMARY

According to one aspect of the embodiments, there is provided a connector conducts electricity between electrode terminals located above and below the connector while the connector is being compressed. The connector includes a main body, a first contact terminal, a second contact terminal and a conductor. The main body is made of an elastic dielectric and is cylindrical in shape. The first contact terminal is an inelastic conductor including first and second electrode sections provided on the top and side surfaces, respectively, of the cylindrical main body and a coupling section interconnecting the first and second electrode sections. The second contact terminal includes third and fourth electrode sections provided on the bottom and side surfaces, respectively, of the cylindrical main body and a coupling section interconnecting the third and fourth electrode sections. The fourth electrode section is an inelastic conductor disposed in a position where the fourth electrode section does not contact the second electrode section. The conductor is provided outside the main body and conducts electricity between the second and fourth electrodes.

According to another aspect of the embodiments, there is provided a connector conducts electricity between electrode terminals located above and below the connector while the connector is being compressed and includes a main body, a first contact terminal and a second contact terminal. The main body is made of an elastic dielectric and is cylindrical in shape. The first contact terminal is an inelastic conductor including a first electrode section provided on the top surface of the cylindrical main body and a second electrode section connected to the first electrode section at the rim of the main body or inside the main body. The second contact terminal is an inelastic conductor including a third electrode section provided on the bottom surface of the cylindrical main body and a contact section connected to the third electrode section and always electrically in contact with the second electrode section at the rim of the main body or inside the main body.

The object and advantages of the embodiments will be realized and attained by means of the elements and combinations particularly pointed out in the claims.

It is to be understood that both the foregoing general description and the following detailed description and are exemplary and explanatory and are not restrictive of the embodiments, as claimed.

DESCRIPTION OF EMBODIMENTS

Embodiments of a connector according to the present invention and an interposer using the connector will be described below with reference to the attached drawings with respect to specific practical examples.

Figure 1A:
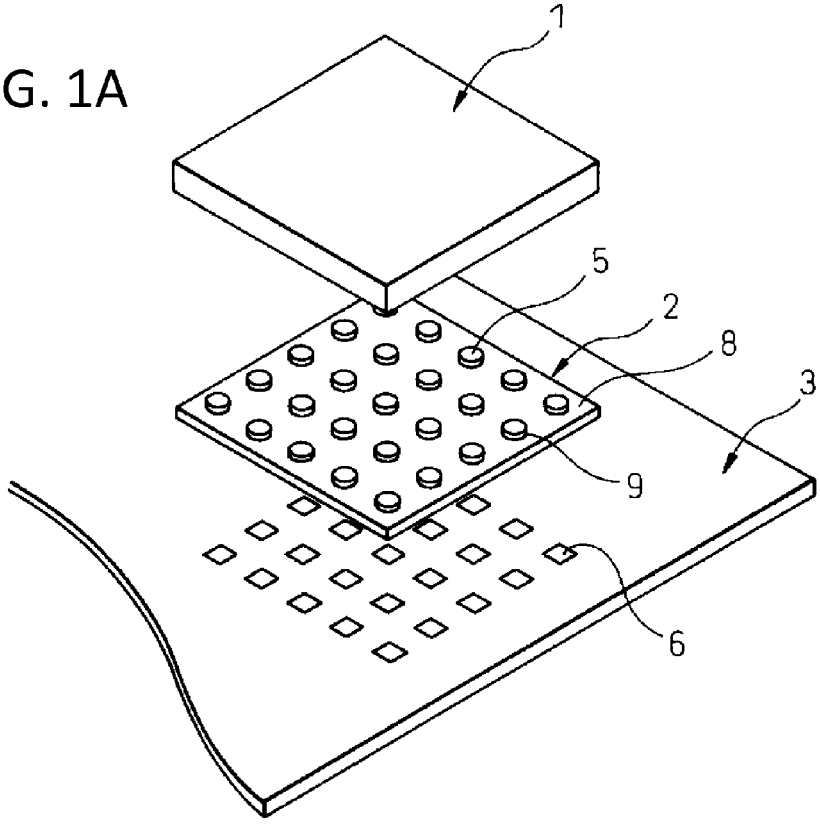
FIG. 1A is an exploded perspective view illustrating how an interposer is mounted in between a circuit board and an IC package.
Figure 1B:
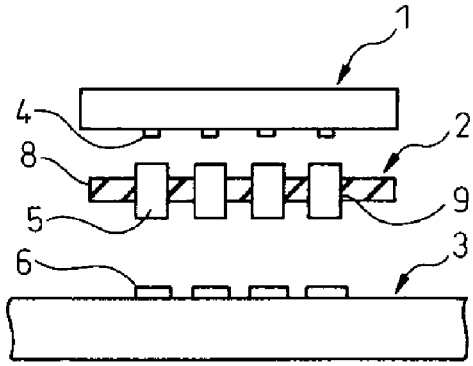
FIG. 1B is a side view of the circuit board and the IC package illustrated in FIG. 1A, including a cross-section of the interposer.

FIG. 1A illustrates an interposer 2 interposed between a circuit board 3 and an IC package 1. FIG. 1B is a side view of the circuit board 3 and the IC package 1, including a cross-sectional view of the interposer 2. Input and output terminals (electrodes) 4 are arranged in a grid array on the back side of the IC package 1. In the region in the circuit board where the IC package is to be mounted, terminal (electrode) traces 6 are formed in locations opposed to the input and output terminals 4. Although omitted from the figures, a pattern of circuits and electronic components to be connected to the terminal traces 6 are provided on the circuit board 3.

The interposer 2 is designed to be attached between the IC package 1 and the circuit board 3 to interconnect the input and output terminals 4 on the back side of the IC package 1 to the corresponding terminal traces 6 on the circuit board 3. The interposer 2 is a thin high-terminal-density connector in which through-holes 9 corresponding to the input and output terminals 4 arranged in a grid array of an IC package 1 are provided in a sheet 8 of insulating material (hereinafter referred to as the interposer substrate) and connectors 5 are inserted in the through-holes 9. The connectors 5 may have the same length and serve as an electric conductor that conducts electricity between both surfaces of the interposer substrate 8.

Figure 1C:
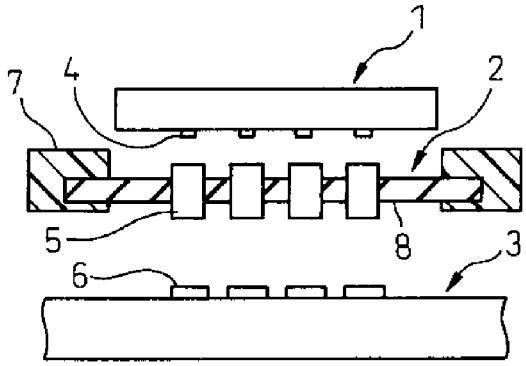
FIG. 1C is a side view illustrating the interposer in FIG. 1B attached to a socket.

When such an interposer 2 is used, the interposer 2 is typically attached inside a socket 7 as illustrated in FIG. 1C. The socket 7 is mounted onto a circuit board 3 by soldering or otherwise. The socket 7 allows the IC package 1 to be readily attached to and detached from the circuit board 3.

Since the connectors 5 are sandwiched and compressed between the input and output terminals 4 on the back surface of the IC package 1 and the terminal traces 6 on the circuit board 3, the connectors 5 are designed to be elastic to contract under the pressures from above and below while conducting electricity between the terminals above and below the connectors 5.

Figure 2A:
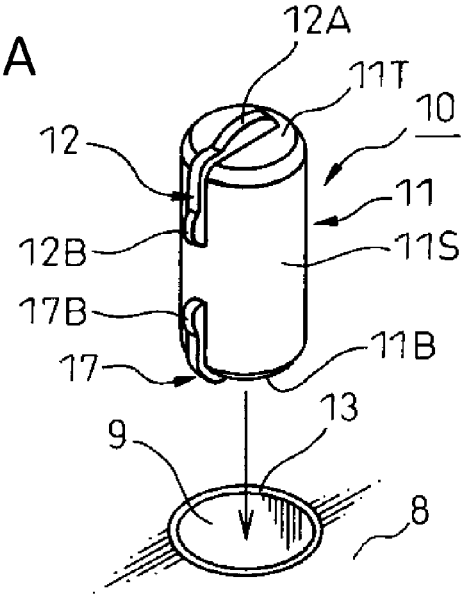
FIG. 2A is a perspective view illustrating a configuration of a first exemplary embodiment of a connector according to the present invention used in the interposer illustrated in FIGS. 1A to 1C.

FIG. 2A illustrates a configuration of a connector 10 of a first exemplary embodiment of the present invention which is used as the connectors 5 illustrated in FIGS. 1A to 1C. The connector 10 of the first exemplary embodiment includes a cylindrical main body 11 made of an elastomer which is an elastic dielectric and two contact terminals 12 and 17 fixed to the main body 11. The contact terminals 12 and 17 are made of an inelastic conductor, for example a metal. The contact terminal fixed onto the top surface of the main body 1 is herein referred to as the first contact terminal 12 and the contact terminal fixed onto the bottom surface as the second contact terminal 17.

The first contact terminal 12 is attached across the edge between the top surface 11T and the side surface 11S of the main body 11 and has a protruding first electrode 12A at the top surface 11T and a protruding second electrode 12B at the side surface 11S. A strip-shaped coupling section is provided between the first and second electrodes 12A and 12B. The second contact terminal 17 is attached across the edge between the bottom surface 11B and the side surface 11S of the main body 11 and has a protruding third electrode 17A at the bottom surface 11B and a protruding fourth electrode 17B at the side surface. A strip-shaped coupling section is provided between the third and fourth electrodes 17A and 17B.

The first and second contact terminals 12 and 17 are provided on the main body 11 along the plane passing through the central axis of the main body 11. The second electrode 12B and the fourth electrode 17B are not in contact with each other but at a distance from each other. The first and second contact terminals 12 and 17 may be fixed to the main body 11 by using an adhesive or by providing protruding needles on the bottom surfaces of the first and second contact terminals 12 and 17 and inserting the needles into the main body 11. While the first and second contact terminals 12 and 17 are thin strips in the first exemplary embodiment, the shape of the first and second contact terminals 12 and 17 is not limited to this. Each of the first and second contact terminals 12 and 17 may be of any shape having electrodes, one at an end surface and the other at the side surface of the main body 11. Also, the first and second contact terminals 12 and 17 do not necessarily need to be in the same plane.

Figure 2B:
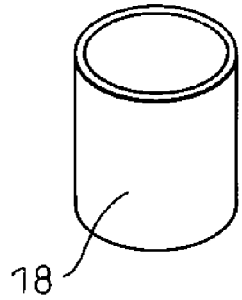
FIG. 2B is a perspective view of a sleeve used in conjunction with the connecter illustrated in FIG. 2A.

A conductor that electrically interconnects the second electrode 12B and the fourth electrode 17B needs to be provided outside the main body 11. Therefore, to incorporate the connector 10 into an interposer substrate 8 as illustrated in FIG. 1, a conducting wall 13 is formed on the inner wall of each hole 9 provided in the interposer substrate 8. Since the main body 11 in the exemplary embodiment is cylindrical and may rotate about its axis line, the conducting wall 13 is provided on the entire inner wall of the hole 9. If an anti-rotation element is provided between the main body 11 and the inner wall of the hole 9, the conducting wall 13 does not need to be provided on the entire inner wall. If the connector 10 is used singly, the connector 10 may be used in conjunction with a sleeve 18 as illustrated in FIG. 2B. The sleeve 18 may be made of a metal.

Figure 2C:
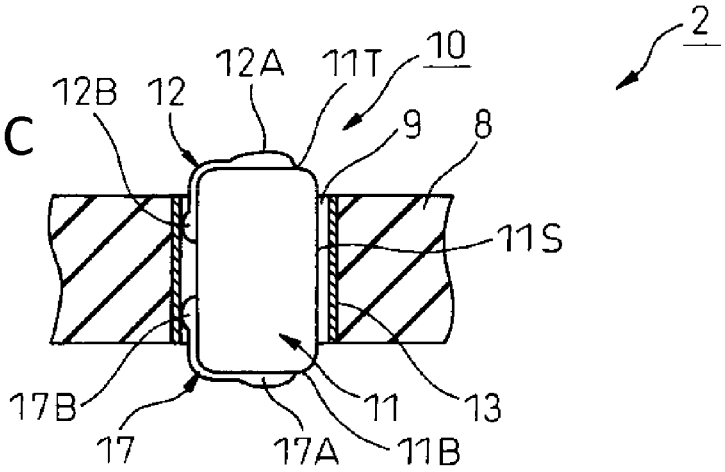
FIG. 2C is a partial enlarged cross-sectional view illustrating the connector illustrated in FIG. 2A incorporated in the interposer.

FIG. 2C illustrates the connector 10 illustrated in FIG. 2A inserted in a hole 9 provided in the interposer substrate 8 to form an interposer 2. The same connectors 10 in FIG. 2C are arranged in a grid array in the interposer 2 as illustrated in FIG. 1A. The interior diameter of the hole 9 and the interior diameter of the sleeve 18 illustrated in FIG. 2B are greater than the sum of the diameter of the main body 11 and the height of the protruding second electrode 12B or fourth electrode 17B. Accordingly, when the connector 10 is not connected to external electrodes above and below the connector 10, it is possible that the second electrode 12B and the fourth electrode 17B do not contact the conducting wall 13.

Figure 2D:
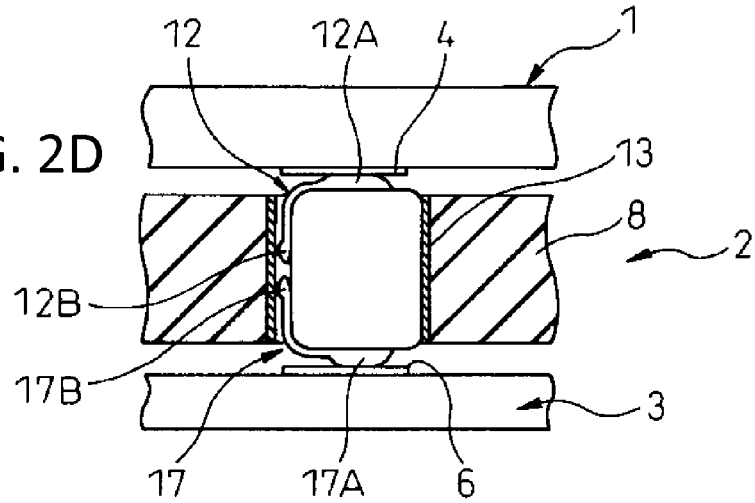
FIG. 2D is a partial enlarged cross-sectional view of the interposer illustrated in FIG. 2C interconnecting two opposed electrodes while being compressed by the opposed electrodes.

However, when the interposer 2 is inserted between an IC package 1 and a circuit board 3 and the connector 10 is compressed to interconnect an input and output terminal 4 and a terminal trace 6 as illustrated in FIG. 2D, the second electrode 12B and the fourth electrode 17B come into contact with the conducting wall 13. This is because the compressed main body 11 expands widthwise to press the second electrode 12B and the fourth electrode 17B against the conducting wall 13 to bring them into contact with the conducting wall 13. The interior diameter of the hole 9 and the interior diameter of the sleeve 18 are chosen so as to allow the second electrode 12B and the fourth electrode 17B to be pressed against and come into contact with the conducting wall 13 when the main body 11 is inserted between an IC package 1 and a circuit board 3 and compressed.

As has been described above, in the connector 10 of the first exemplary embodiment and the interposer 2 incorporating the connector 10, the main body 11 made of an elastomer receives a compression force applied to the connector 10 and the first and second metal terminals 12 and 17 provide electrical pathways during conduction. Accordingly, a low constant resistance may be ensured during conduction in the connector 10 of the first exemplary embodiment and the interposer 2 incorporating the connector 10. As variations of the connector 10, a configuration illustrated in FIGS. 3A and 3B and a configuration illustrated in FIGS. 3C and 3D are possible in which the second electrode 12B and the fourth electrode 17B are brought into contact with the conducting wall 13 while the connector 10 is not connected to electrode terminals above and below the connector 10.

Figure 3A:
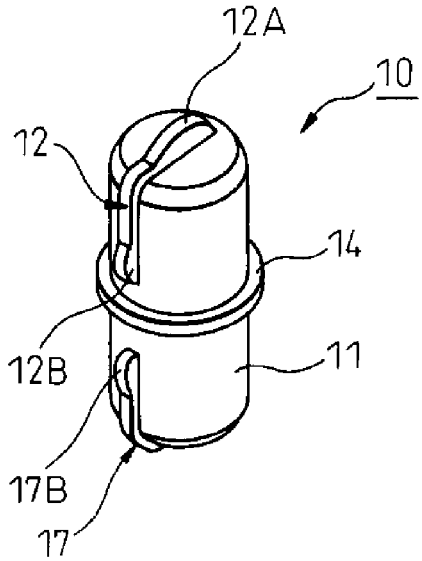
FIG. 3A is a perspective view of a first variation of the connector illustrated in FIG. 2A.
Figure 3B:
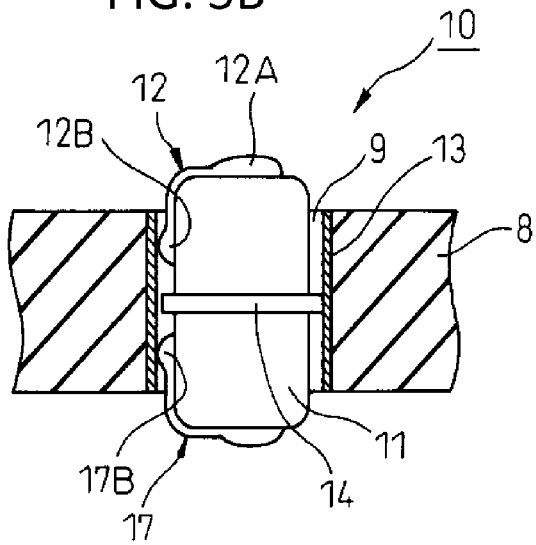
FIG. 3B is a partial enlarged view of the connector illustrated in FIG. 3A, incorporated in an interposer.

In the configuration illustrated in FIGS. 3A and 3B, a flange 14 is provided around the rim of the main body 11 in the center of the length of the main body 11. In the configuration, the height of the flange 14 allows the second electrode 12B and the fourth electrode 17B to be always kept in contact with the conducting wall 13. Since spaces are provided over and under the flange 14, the main body 11 inserted and compressed between an IC package 1 and a circuit board 3 may be safely deformed.

Figure 3C:
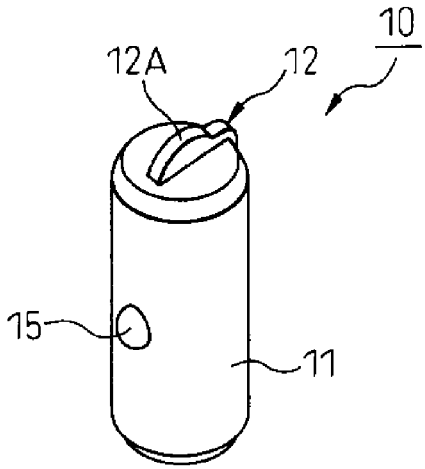
FIG. 3C is a second variation of the connector illustrated in FIG. 2A.
Figure 3D:
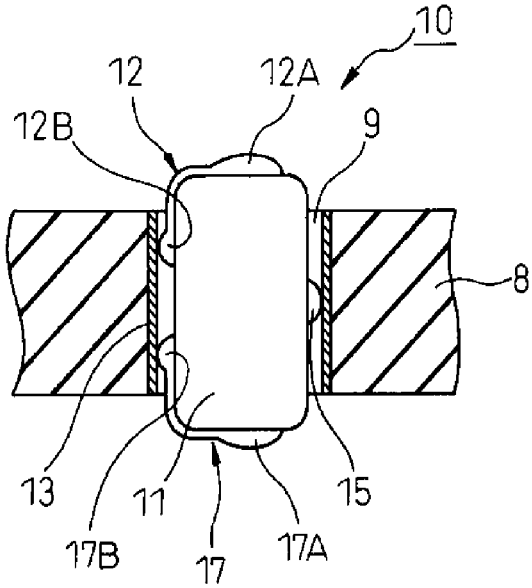
FIG. 3D is a partial enlarged view of the connector in FIG. 3C, incorporated in an interposer.

In the configuration illustrated in FIGS. 3C and 3D, a semispherical protrusion 15 is provided on the rim of the main body 11 in the center of the length of the main body 11 on the side opposite from the second and fourth electrodes 12B and 17B. In the configuration, the height of the protrusion 15 allows the second and the fourth electrodes 12B and 17B to be always kept in contact with the conducting wall 13. Since spaces are provided around the protrusion 15, the main body 11 inserted and compressed between an IC package 1 and a circuit board 3 may be safely deformed.

Figure 4A:
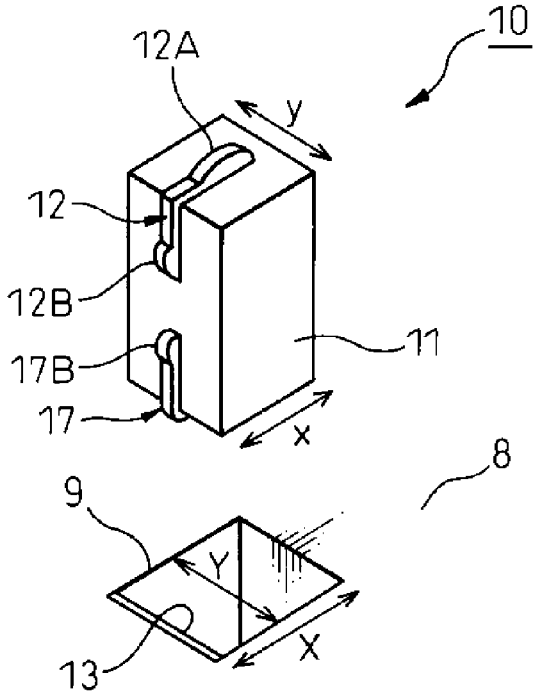
FIG. 4A is a perspective view illustrating a configuration of a second exemplary embodiment of a connector according to the present invention used in the interposer illustrated in FIGS. 1A to 1C.

FIG. 4A illustrates a configuration of a connector 10 of a second exemplary embodiment of the present invention that is used in place of each of the connectors 5 illustrated in FIGS. 1A to 1C. The connector 10 of the second exemplary embodiment is similar to the connector 10 of the first exemplary embodiment with the only difference being the shape of the main body 11 made of an elastomer which is an elastic dielectric. The shape of first and second contact terminals 12 and 17 are almost the same as those of the first exemplary embodiment and therefore the same sections as those of the first exemplary embodiment are labeled the same reference numerals and description of the sections will be omitted. Only differences from the first exemplary embodiment will be described.

In the second exemplary embodiment, the main body 11 has the shape of a quadrangular prism with a square horizontal cross section. Accordingly, the holes 9 provided in an interposer substrate 8 are square in shape. Since the hole 9 is square, the connector 10 does not rotate about its axis line in the hole 9. Therefore, the conducting wall 13 needs only to be provided on the side of the hole 9 that faces the first and second contact terminals 12 and 17.

The length of the hole 9 in the X direction is greater than the sum of the corresponding length of the main body 11 in the X direction and the height of the protruding second electrode 12B or fourth electrode 17B. The length of the hole 9 in the Y direction is greater than the corresponding length of the main body 11 in the Y direction. Accordingly, when the connector 10 is not connected to external electrodes above and below the connector 10, it is possible that the second electrode 12B and the fourth electrode 17B do not contact the conducting wall 13. The length of the hole 9 in the X and Y directions is chosen so as to allow the second electrode 12B and the fourth electrode 17B to be pressed against and come into contact with the conducting wall 13 when the main body 11 is inserted and compressed between an IC package 1 and a circuit board 3 and deformed.

Figure 4B:
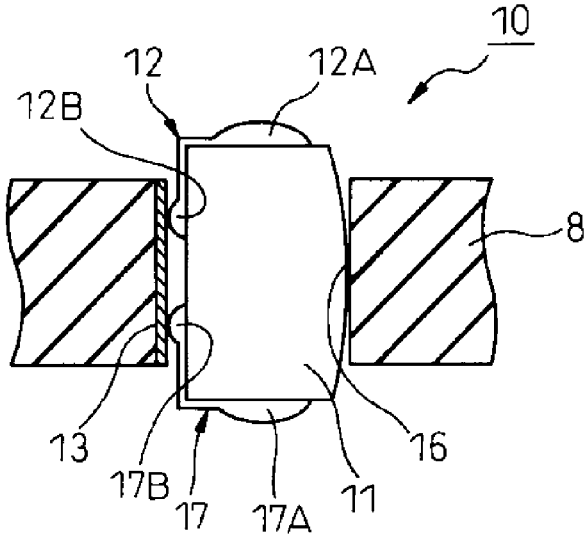
FIG. 4B is a partial enlarged cross-sectional view of a variation of the connector illustrated in FIG. 4A, incorporated in the interposer.
Figure 4C:
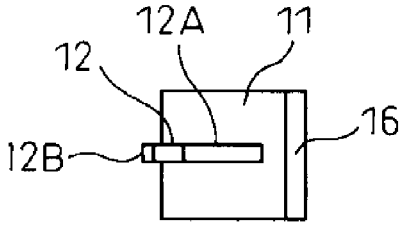
FIG. 4C is a plan view of the connector illustrated in FIG. 4B.
Figure 4D:
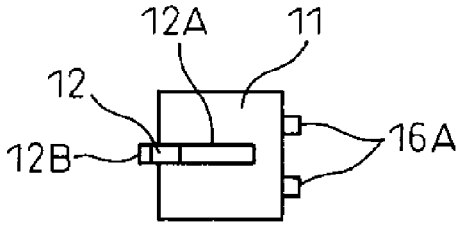
FIG. 4D is a plan view of a variation of the connector illustrated in FIG. 4C.

As variations of the connector 10, a configuration illustrated in FIGS. 4B and 4C and a configuration illustrated in FIG. 4D are possible in which the second electrode 12B and the fourth electrode 17B are brought into contact with the conducting wall 13 while the connector 10 is not connected to external electrodes above and below the connector 10.

In the configuration illustrated in FIGS. 4B and 4C, a curved bulge 16 is formed at the main body 11 on the side opposite from the side facing the conducting wall 13 of the main body 11. While the bulge 16 is curved along the length of the main body 11 in the variation, the curved bulge may be curved along the width of the main body. Alternatively, a spherical surface may be provided instead of the curved bulge. In this configuration, the height of the bulge 16 allows the second electrode 12B and the fourth electrode 17B to be always kept in contact with the conducting wall 13. Since the curved bulge 16 comes into line contact with the wall of the hole 9, spaces are provided on both sides of the line of contact and therefore the main body 11 inserted and compressed between an IC package 1 and a circuit board 3 may be safely deformed. The same applies to a spherical bulge 16.

In the configuration illustrated in FIG. 4D, two narrow raised strips 16A are provided instead of the curved bulge 16 illustrated in FIGS. 4B and 4C. The rim of each of the raised strips 16A is curved like the curved surface of the bulge 16. In this configuration, the height of the raised strips 16A allows the second electrode 12B and the fourth electrode 17B to be always kept in contact with the conducting wall 13. Since spaces are provided around the raised strips 16A, the main body 11 inserted and compressed between an IC package 1 and a circuit board 3 may be safely deformed.

Figure 5A:
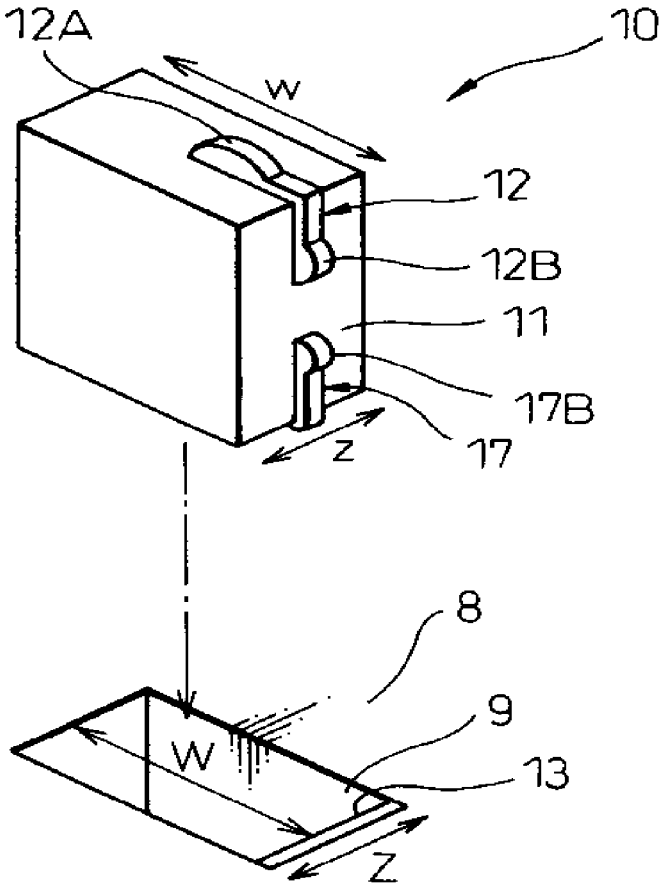
FIG. 5A is a perspective view illustrating a configuration of a third exemplary embodiment of a connector according to the present invention used in the interposer illustrated in FIGS. 1A to 1C.

FIG. 5A illustrates a configuration of a connector 10 of a third exemplary embodiment of the present invention that is used in place of each of the connectors 5 illustrated in FIGS. 1A to 1C. The connector 10 of the third exemplary embodiment differs from the connector 10 of the second exemplary embodiment only in that the shape of a horizontal cross-section is rectangular instead of square. The first and second contact terminals 12 and 17 are identical in shape to those in the second exemplary embodiment and therefore the same sections as those in the second exemplary embodiments are labeled the same reference numerals and the description of the sections will be omitted. Only differences from the second exemplary embodiment will be described.

The main body 11 of the second exemplary embodiment has the shape of a quadrangular prism having a square horizontal cross-section. Accordingly, the holes 9 provided in the interposer substrate 8 are also square in shape. On the other hand, the main body 11 in the third exemplary embodiment has the shape of a quadrangular prism having a rectangular horizontal cross-section. Accordingly, the holes 9 provided in an interposer substrate 8 are rectangular in shape. In this case, the length of a hole 9 in the W direction is equal to the sum of the corresponding length of the main body 11 in the W direction and the height of the protruding second electrode 12B or fourth electrode 17B. The length of the hole 9 in the Z direction is well greater than the corresponding length of the main body 11 in the Z direction so that spaces are provided between the main body 11 and the wall of the hole 9.

Accordingly, the second electrode 12B and the fourth electrode 17B come into contact with the conducting wall 13 while the connector 10 is not connected to external electrodes located above and below the connector 10. In this configuration, when the main body 11 is inserted and compressed between an IC package 1 and a circuit board 3, deformation of the main body 11 is allowed in the spaces in the Z direction.

Figure 5B:
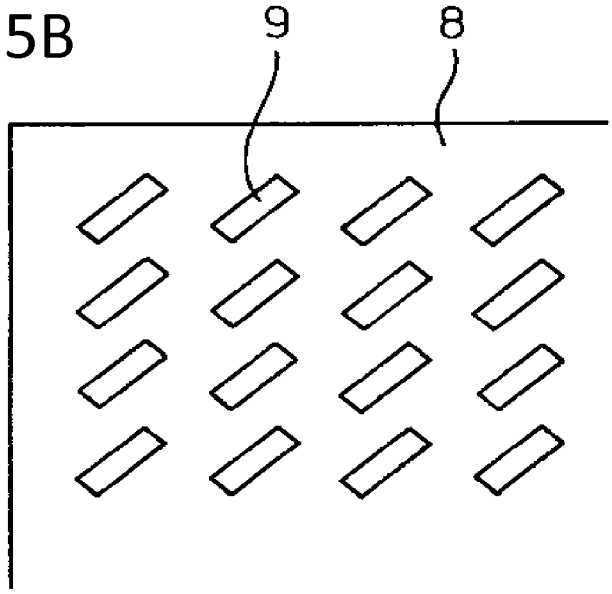
FIG. 5B is a partial plan view of the connector illustrated in FIG. 5A, incorporated in an interposer.

If the holes 9 are arranged diagonally as illustrated in FIG. 5B, the pitch between adjacent holes 9 increases by a factor of 1.4 as illustrated in FIG. 5B and therefore larger substrate area may be used in designing the interposer.

Figure 6A:
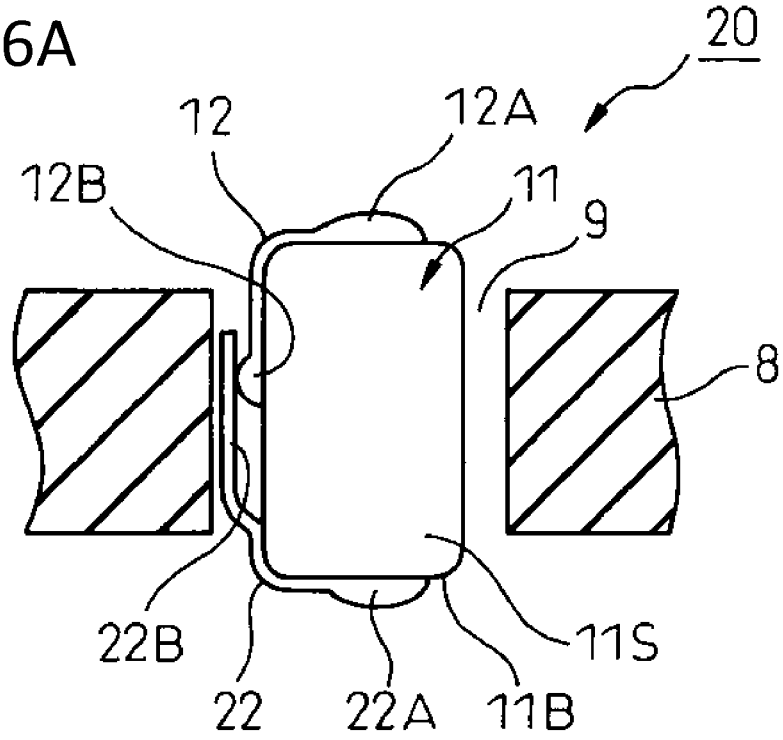
FIG. 6A is a sectional side view of a connector according to a fourth exemplary embodiment of the present invention used and incorporated in the interposer illustrated in FIGS. 1A to 1C.

FIG. 6A illustrates a configuration of a connector 20 of a fourth exemplary embodiment of the present invention which is used as each of the connectors 5 illustrated in FIGS. 1A to 1C. The connector 20 of the fourth exemplary embodiment differs from the connectors 10 of the first to third exemplary embodiments in that the conductor outside the main body 11 is omitted but first and second contact terminals 12 and 22 are always electrically interconnected even when the connector 20 is not connected to external electrodes located above and below the connector 20.

Therefore, while the first contact terminal 12 of the connector 20 of the fourth exemplary embodiment is identical in shape to the first contact terminal 12 of the first exemplary embodiment, the second contact terminal 22 is significantly different in shape from the second contact terminal 17 of the first exemplary embodiment. The same components in the fourth exemplary embodiment are labeled the same reference numerals in the fourth exemplary embodiment as those described with respect to the first exemplary embodiment and the description of those components will be omitted from the following description. Only differences from the first exemplary embodiment will be described.

Figure 6B:
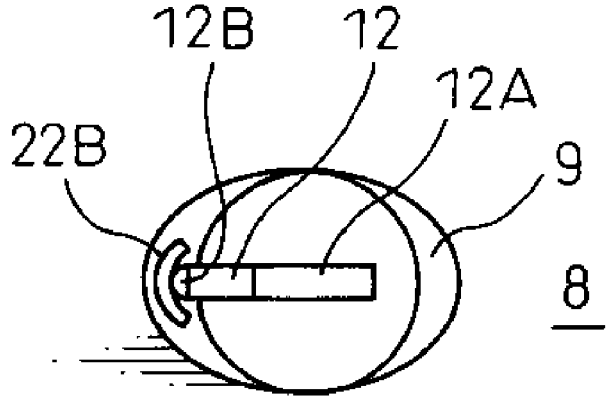
FIG. 6B is a plan view of the connector incorporated in the interposer illustrated in FIG. 6A.

The second contact terminal 22 in the fourth exemplary embodiment is attached across the edge between the bottom surface 11B and the side surface 11S of the main body 11. A protruding third electrode 22A is provided on the bottom surface 11B and a receiving section 22B extends from the side surface to the first contact terminal 12 with a predetermined distance away from the main body 11. The distance between the receiving section 22B and the main body 11 is equal to the distance from the side surface of the main body 11 to the tip of a protruding second electrode 12B. Accordingly, a portion of the receiving section 22B near the tip of the receiving section 22B is electrically connected to the protruding second electrode 12B of the first contact terminal 12. The receiving section 22B may be of a plate shape or of a curved shape having a concave on the main body 11 side that receives the protruding second electrode 12B of the first contact terminal 12 as illustrated in FIG. 6B.

Each of holes 9 provided in an interposer substrate 8 in the fourth exemplary embodiment may have any shape and size that may accommodate the main body 11 and the first and second contact terminals 12 and 22. This is because the first and second contact terminals 12 and 22 are always electrically interconnected and therefore a conducting wall does not need to be provided in the hole 9.

In the case of the connector 20 of the fourth exemplary embodiment, when the connector 20 is connected with external electrodes located above and below the connector 20, the main body 11 is compressed and the protruding second electrode 12B of the first contact terminal 12 slides on the receiving section 22B of the second contact terminal 22. In the sliding, the compression expands the main body 11 outward, which presses the protruding second electrode 12B of the first contact terminal 12 outward and enhances the contact between the second electrode 12B and the receiving section 22B of the second contact terminal 22.

Figure 7A:
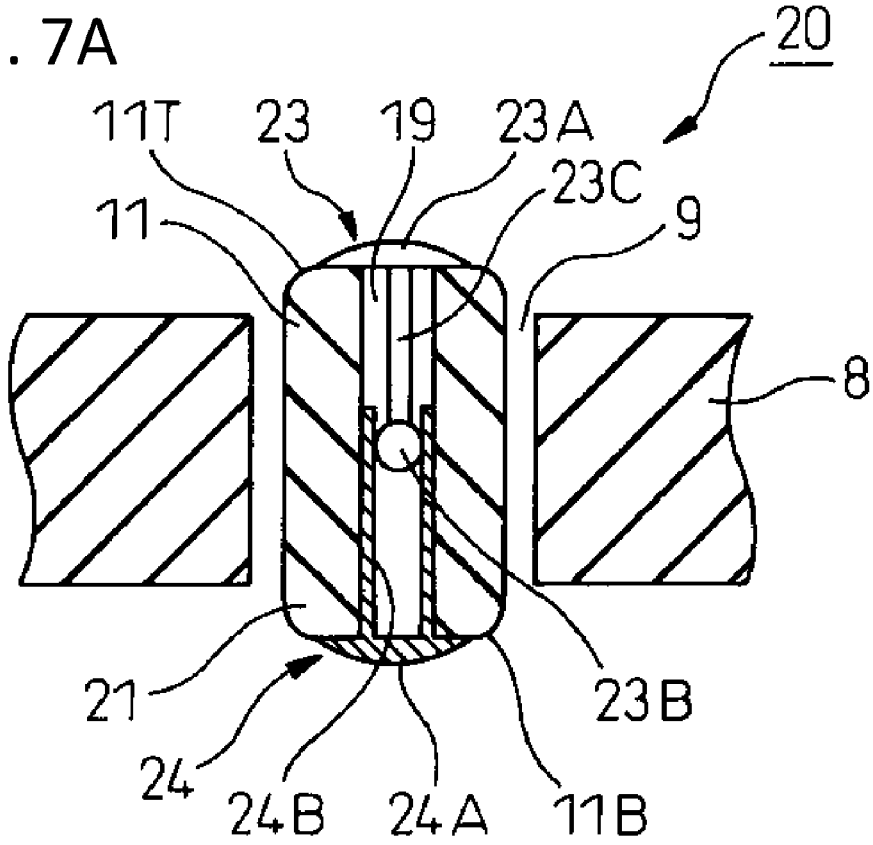
FIG. 7A is a sectional side view illustrating a connector of a fifth exemplary embodiment of the present invention used and incorporated in the interposer illustrated in FIGS. 1A to 1C.

FIG. 7A illustrates a configuration of a connector 20 of a fifth exemplary embodiment of the present invention which is used as each connector 5 illustrated in FIGS. 1A to 1C. The connector 20 of the fifth exemplary embodiment differs from the connector 20 of the fourth exemplary embodiment in that first and second contact terminals 23 and 24 are always in contact with each other inside the main body 11. For the purpose of the connection, a vertical conducting hole 19 is provided in the main body 11.

The first contact terminal 23 in the fifth exemplary embodiment has a protruding first electrode 23A on the top surface 11T of the main body 11 and a rod section 23C extending from under the first electrode 23A into the conducting hole 19. A spherical section 23B, which is a second electrode section, is at the tip of the rod section 23C. The second electrode section may have a protruding shape instead of a spherical shape. The second contact terminal 24 has a protruding third electrode 24A on the bottom surface 11B of the main body 11 and a cylindrical section 24B, which is a fourth electrode section extending from the bottom surface of the third electrode 24A into the conducting hole 19. The spherical section 23B, which is the second electrode section, is placed in the internal space near the tip of the cylindrical section 24B and is in contact with the interior surface of the cylindrical section 24B. If the second electrode section has a protruding shape, the tip of the protrusion may be brought into contact with the interior surface of the cylindrical section 24B.

Figure 7B:
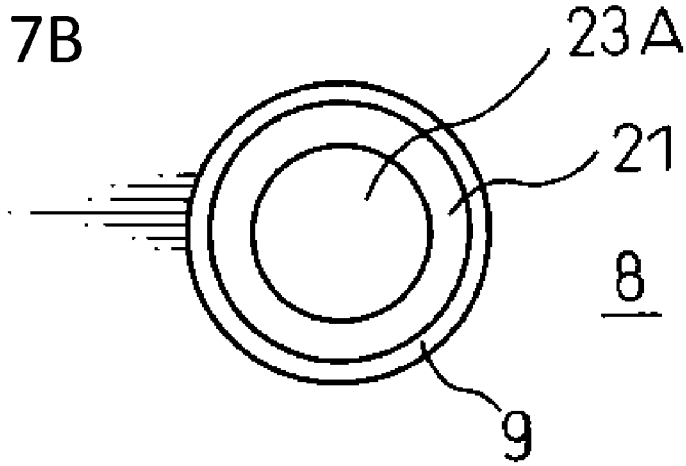
FIG. 7B is a plan view of the connector incorporated in the interposer illustrated in FIG. 7A.

Holes 9 provided in an interposer substrate 8 in the fifth exemplary embodiment may have any shape and size that may accommodate the main bodies 11. This is because the first and second contact terminals 23 and 24 are always electrically interconnected and a conducting wall does not need to be provided in the holes 9 in the fifth exemplary embodiment, like the fourth exemplary embodiment. FIG. 7B illustrates an exemplary embodiment of the interposer substrate 8 in which holes 9 are circular in shape.

In the case of the connector 20 of the fifth exemplary embodiment, when the connector 20 is connected with external electrodes located above and below the connector 20, the main body 11 is compressed and the spherical section 23B of the first contact terminal 23 slides on the internal surface of the cylindrical section 24B of the second contact terminal 24. In the sliding, the compression expands the main body 11 outward and therefore the cylindrical section 24B of the second contact terminal 24 is pressed inward, which enhances the contact between the cylindrical section 24B and the spherical section 23B of the first contact terminal 23.

When an interposer 2 incorporating the connectors 20 of any of the fourth and fifth exemplary embodiments is used, the interposer 2 may be attached in the socket illustrated in FIG. 1C. The first and second contact terminals in the interposer 2 incorporating the connectors 20 of any of the fourth and fifth exemplary embodiments are directly in contact with each other. Therefore, the interposer 2 of any of the fourth and the fifth exemplary embodiments is capable of improving the signal quality and reliability of (removable) stack mounting of a fast, large-sized IC package and providing an approach to developing a faster and denser device.

The present invention has been described in detail specifically with reference to preferred embodiments thereof. To facilitate the understanding of the present invention, specific modes of the present invention will be given below.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a depicting of the superiority and inferiority of the invention. Although the embodiments of the present invention have been described in detail, it should be understood that the various changes, substitutions, and alterations could be made hereto without departing from the spirit and scope of the invention.

What is claimed is:

1. A connector conducting electricity between external electrodes disposed above and below the connector while the connector is being compressed, the connector comprising:

a columnar main body made of an elastic dielectric;

a first contact terminal made of an inelastic conductor including first and second electrode sections provided on a top surface and a side surface, respectively, of the columnar main body and a connecting section interconnecting the first and second electrode sections;

a second contact terminal made of an inelastic conductor including third and fourth electrode sections provided on a bottom surface and a side surface, respectively, of the columnar main body and a connecting section interconnecting the third and fourth electrode sections, the fourth electrode section being disposed in a position in which the fourth electrode section does not contact the second electrode section; and a conductor wall provided outside and surrounding the main body and conducting electricity between the second and fourth electrode sections, wherein the second electrode section of the first contact terminal and the fourth electrode section of the second contact terminal are in contact with the conductor wall while the main body is being compressed by the external electrodes, the first and third electrode sections being in contact with the external electrodes.

2. The connector according to claim 1, wherein a protrusion bulging outward from the main body is provided on each of the first to fourth electrode sections.

3. The connector according to claim 1, wherein a protrusion bulging outward from the main body is provided in each of the first and third electrode sections.

4. The connector according to claim 1, wherein the main body is rectangular parallelepipedal, cylindrical or polygonal columnar in shape.

5. The connector according to claim 1, wherein the main body is made of an elastomer.

* * * * *